US008973918B2

(12) United States Patent
Muramatsu et al.

(10) Patent No.: US 8,973,918 B2
(45) Date of Patent: Mar. 10, 2015

(54) SHEET CONVEYING APPARATUS AND IMAGE FORMING APPARATUS

(71) Applicant: Canon Kabushiki Kaisha, Tokyo (JP)

(72) Inventors: Motoyasu Muramatsu, Susono (JP); Takashi Kuwata, Suntou-gun (JP); Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/104,287

(22) Filed: Dec. 12, 2013

(65) Prior Publication Data

US 2014/0175737 A1 Jun. 26, 2014

(30) Foreign Application Priority Data

Dec. 26, 2012 (JP) ..... 2012-283306

(51) Int. Cl.
*B65H 9/04* (2006.01)
*B65H 9/00* (2006.01)
*B65H 9/06* (2006.01)

(52) U.S. Cl.
CPC . *B65H 9/002* (2013.01); *B65H 9/06* (2013.01)
USPC ..... 271/243; 271/246; 271/253

(58) Field of Classification Search
USPC ..... 271/243, 245, 246, 253
See application file for complete search history.

(56) References Cited

U.S. PATENT DOCUMENTS 5,765,826 A 6/1998 Isoda et al.
6,011,948 A 1/2000 Amano et al.
6,371,021 B1 * 4/2002 Rombult ..... 101/232
6,527,267 B1 3/2003 Kuwata et al.
6,643,480 B2 11/2003 Kuwata et al.
6,661,995 B2 12/2003 Isobe et al.
6,912,044 B2 6/2005 Sekiyama et al.
6,997,456 B2 2/2006 Fukatsu et al.
8,340,563 B2 12/2012 Nakajima et al.
8,342,519 B2 * 1/2013 Watanabe et al. ..... 271/243
2005/0196210 A1 9/2005 Suzuki et al.
2011/0070008 A1 3/2011 Hayakawa et al.
2011/0089628 A1 * 4/2011 Watanabe et al. ..... 271/110

FOREIGN PATENT DOCUMENTS

JP 09-183539 A 7/1997
JP 09183539 A 7/1997
WO 2011/048668 A1 4/2011

OTHER PUBLICATIONS

Great Britain Search Report issued in counterpart Great Britain Application No. 1322880.4, dated Jul. 21, 2014.

* cited by examiner

*Primary Examiner* — Michael McCullough
(74) *Attorney, Agent, or Firm* — Fitzpatrick, Cella, Harper & Scinto

(57) ABSTRACT

A sheet conveying apparatus including: a skew feeding correcting portion configured to correct skew feeding of a sheet, the skew feeding correcting portion including: a rotary member pair configured to convey the sheet; a shutter member configured to abut against a leading edge of a sheet being conveyed, and having a home position; and a moving member arranged with a gap formed between the moving member and the shutter member positioned in the home position, such that the shutter member is moveable independently from the home position up to a point of engagement with the moving member, when the gap is closed, and such that the moving member is movable integrally with the shutter member while the gap is closed, wherein the rotary member pair is arranged to nip a sheet during a period in which the shutter member is configured to move integrally with the moving member.

57 Claims, 17 Drawing Sheets

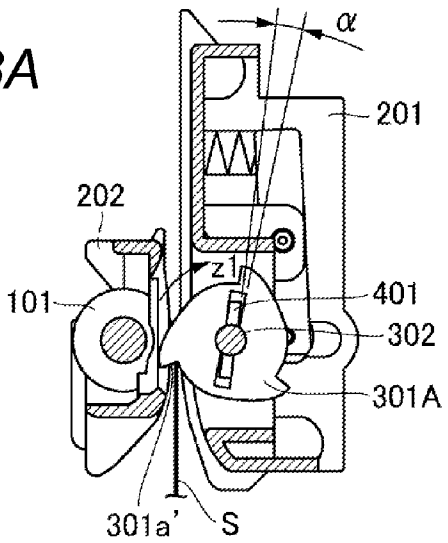
FIG. 8A
FIG. 8C
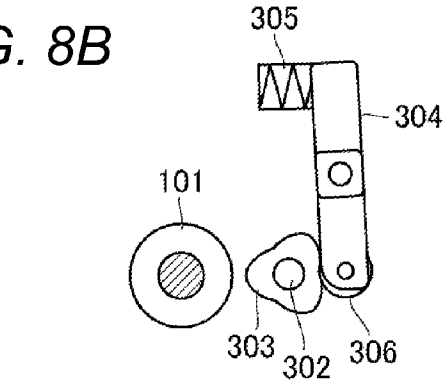
FIG. 8B
FIG. 8D

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and more particularly, to the structure of a skew feeding correcting portion configured to correct skew feeding of a sheet.

2. Description of the Related Art

According to the related art, an image forming apparatus such as a copying machine, a printer, and a facsimile machine includes an image forming portion, and a sheet conveying apparatus configured to convey a sheet to the image forming portion by a conveyance roller. In the image forming apparatus according to the related art, due to deformation of the conveyance roller, misalignment of the conveyance roller, and the like, the sheet may sometimes be skewed when the sheet is conveyed. In the image forming apparatus, the position of the sheet with respect to the image forming portion significantly affects accuracy of an image forming position with respect to the sheet, and hence accurate alignment of the position of the sheet with respect to the image forming portion is an important factor to secure image quality.

In view of the above, in the image forming apparatus according to the related art, a skew feeding correcting portion is provided to the sheet conveying apparatus, and this skew feeding correcting portion corrects the skew feeding of the sheet, to thereby enhance the accuracy of the image forming position. As the skew feeding correcting portion described above, for example, there is known a skew feeding correcting portion including a shutter biased by a spring or the like in a direction opposite to a sheet conveying direction so as to bring a leading edge of the sheet into abutment against the shutter (Japanese Patent Application Laid-Open No. H09-183539 and International Patent WO2011/048668A). In the shutter-type skew feeding correcting portion described above, the leading edge of the sheet is brought into abutment against an abutment portion of a shutter member positioned perpendicularly to the sheet conveying direction, and the leading edge of the sheet is aligned with the abutment portion, to thereby correct the skew feeding of the sheet.

By the way, in recent years, there has been a users' demand to enhance productivity of the image forming apparatus and reduce operation sound. However, in the case where the skew feeding is corrected by bringing the sheet into abutment against the shutter member as in the sheet conveying apparatus according to the related art, when the leading edge of the conveyed sheet is brought into abutment against the shutter member, collision sound is generated. The collision sound becomes louder when the sheet conveying speed increases to enhance the productivity.

SUMMARY OF THE INVENTION

The present invention has been made in view of the above-mentioned circumstances, and it is therefore an object thereof to provide a sheet conveying apparatus and an image forming apparatus, which is configured to reduce collision sound to be generated due to abutment between a sheet and a shutter member.

According to one embodiment of the present invention, a sheet conveying apparatus configured to convey a sheet, comprises:

a skew feeding correcting portion configured to correct skew feeding of a sheet, the skew feeding correcting portion including:

a rotary member pair configured to convey the sheet;

a shutter member configured to abut against a leading edge of a sheet being conveyed, and having a home position; and a moving member arranged with a gap formed between the moving member and the shutter member positioned in the home position, such that the shutter member is moveable independently from the home position up to a point of engagement with the moving member, when the gap is closed, and such that the moving member is movable integrally with the shutter member while the gap is closed, wherein the rotary member pair is arranged to nip a sheet during a period in which the shutter member is configured to move integrally with the moving member.

Further features of the present invention will become apparent from the following description of exemplary embodiments with reference to the attached drawings.

BRIEF DESCRIPTION OF THE DRAWINGS

FIGS. 8A, 8B, 8C, and 8D are first explanatory views illustrating a skew feeding correcting operation of the skew feeding correcting portion.

DESCRIPTION OF THE EMBODIMENTS

Figure 1:
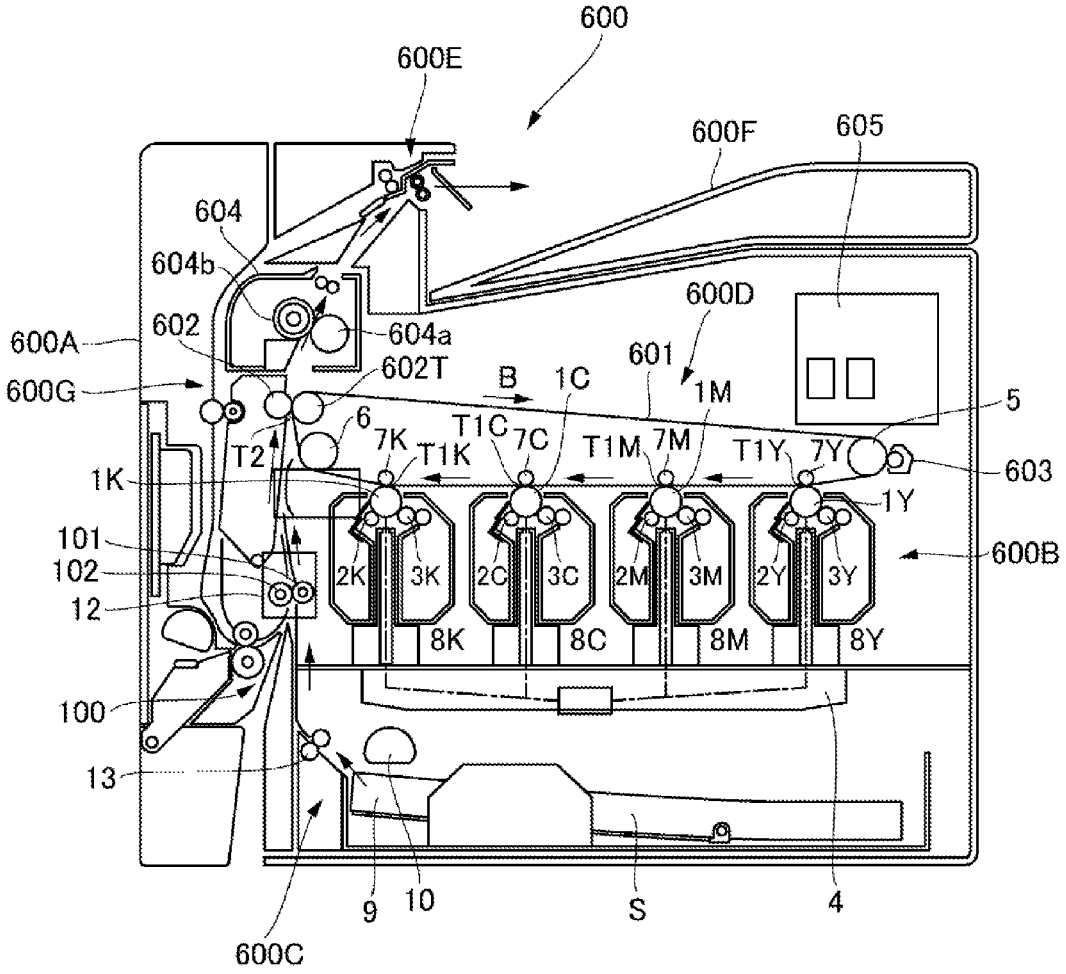
FIG. 1 is an overall structural view of a color laser printer serving as an example of an image forming apparatus including a sheet conveying apparatus according to a first embodiment of the present invention.

Now, exemplary embodiments of the present invention will be described in detail with reference to the attached drawings. FIG. 1 is an overall structural view of a color laser printer serving as an example of an image forming apparatus including a sheet conveying apparatus according to a first embodiment of the present invention. In FIG. 1, a color laser printer 600 has a full-color laser printer main body (hereinafter referred to as "printer main body") 600A. The printer main body 600A includes an image forming portion 600B configured to form an image on a sheet, a sheet feeding portion 600C for feeding the sheet, a sheet conveying apparatus 100 configured to convey, to the image forming portion 600B, the sheet fed from the sheet feeding portion 600C, and the like.

The image forming portion 600B includes process cartridges 8 (8Y, 8M, 8C, and 8K) removably mounted to the printer main body 600A, and is configured to form toner images of four colors, specifically, yellow, magenta, cyan, and black, respectively. In this case, the process cartridges 8 include photosensitive drums 1 (1Y, 1M, 1C, and 1K) serving as image bearing members, charging rollers (2Y, 2M, 2C, and 2K), and developing rollers 3 (3Y, 3M, 3C, and 3K), respectively. Further, the image forming portion 600B includes a scanner unit 4 arranged below the process cartridges 8 in a vertical direction, and configured to radiate laser beams based on image information to form electrostatic latent images on the respective photosensitive drums 1.

Further, in FIG. 1, the printer main body 600A includes an intermediate transfer belt unit 600D, and the intermediate transfer belt unit 600D includes an intermediate transfer belt 601, and primary transfer rollers 7 (7Y, 7M, 7C, and 7K) arranged on an inner side of the intermediate transfer belt 601. Note that, the intermediate transfer belt 601 is stretched around a secondary transfer opposing roller 602T, a drive roller 6, and a tension roller 5. In this case, the drive roller 6 is a roller configured to drive the intermediate transfer belt 601 in a direction indicated by the arrow B (clockwise) so that the surface speed of the intermediate transfer belt 601 becomes substantially equal to the surface speed of each photosensitive drum 1. Further, the drive roller 6 is rotationally driven by a drive source (not shown).

Further, the primary transfer rollers 7 are arranged to be opposed to the respective photosensitive drums 1 to form primary transfer portions T1 (T1Y, T1M, T1C, and T1K), and a bias applying unit (not shown) applies a transfer bias to the primary transfer rollers 7. Then, the primary transfer rollers 7 apply a primary transfer bias to the intermediate transfer belt 601, and hence the toner images of the respective colors on the photosensitive drums are sequentially transferred onto the intermediate transfer belt 601. In this manner, full-color images are formed on the intermediate transfer belt 601. Further, the secondary transfer opposing roller 602T and a secondary transfer roller 602 form a secondary transfer portion T2 configured to transfer, onto the sheets, the full-color images sequentially formed on the intermediate transfer belt 601.

The sheet feeding portion 600C includes a sheet feeding cassette 9 removably mounted to the printer main body 600A, a pickup roller 10 configured to feed sheets S contained in the sheet feeding cassette 9. The sheet conveying apparatus 100 includes a sheet separating portion 13 configured to separate the sheets S fed by the pickup roller 10 into each single sheet S, and a skew feeding correcting portion 12 configured to correct a leading edge of the sheet S passing through the sheet separating portion to become in parallel to a leading edge of an image region including the toner image on the intermediate transfer belt 601. Note that, after correcting the skew feeding of the sheet S, the skew feeding correcting portion 12 guides the sheet S into the secondary transfer portion T2 in synchronization with a timing when the toner images on the intermediate transfer belt 601 arrive at the secondary transfer portion T2.

Note that, in FIG. 1, a fixing portion 604 fixes the toner images by heating and pressurizing the images formed on the sheet S. The fixing portion 604 includes a heating roller 604*a*, and a pressure roller 604*b* held in pressure contact with the heating roller 604*a*. Further, a control circuit board 605 serving as a control unit controls the color laser printer 600. Based on a print start signal, the control circuit board 605 causes yellow, magenta, cyan, and black toner images to be formed on the respective photosensitive drums 1.

Next, an image forming operation of the color laser printer 600 having the above-mentioned structure will be described. When image signals are input from a personal computer (not shown) or the like to the scanner unit 4, the scanner unit 4 irradiates the photosensitive drums 1 with laser beams corresponding to the respective image signals. At this time, the surfaces of the photosensitive drums 1 are uniformly charged at predetermined polarity and potential by the charging rollers 2 in advance, and electrostatic latent images are formed on the surfaces through the irradiation of the laser beams from the scanner unit 4. After that, those electrostatic latent images are developed and visualized by the developing rollers 3.

In this color laser printer 600, the scanner unit 4 first irradiates the photosensitive drum 1Y with a laser beam corresponding to an image signal of a yellow component of an original, to thereby form an electrostatic latent image for yellow on the photosensitive drum 1Y. Then, the developing roller 3Y develops the electrostatic latent image for yellow with yellow toner, to thereby visualize the electrostatic latent image as a yellow toner image. After that, along with rotation of the photosensitive drum 1Y, the yellow toner image arrives at the primary transfer portion T1Y formed through abutment between the photosensitive drum 1Y and the intermediate transfer belt 601, and then the yellow toner image on the photosensitive drum 1Y is transferred onto the intermediate transfer belt 601 due to the primary transfer bias applied to the primary transfer roller 7Y.

When a part of the intermediate transfer belt 601 which bears the yellow toner image then moves, a magenta toner image formed on the photosensitive drum 1M by a method similar to the above-mentioned method by the time of movement of the intermediate transfer belt 601 is transferred onto the intermediate transfer belt 601 while being superimposed on the yellow toner image. Similarly, along with the movement of the intermediate transfer belt 601, a cyan toner image and a black toner image are transferred at the respective primary transfer portions T1C and T1K while being superimposed on the yellow toner image and the magenta toner image. In this manner, full-color toner images are formed on the intermediate transfer belt 601.

Further, in parallel with the toner image forming operation, the sheets S contained in the sheet feeding cassette 9 are fed by the pickup roller 10, and then separated by the sheet separating portion 13 serving as a sheet conveying unit into each single sheet S to be conveyed. After that, the sheet S is conveyed to the skew feeding correcting portion 12, and the skew feeding is corrected by the skew feeding correcting portion 12. Then, the sheet S is conveyed to the secondary transfer portion T2 by the skew feeding correcting portion 12 so that the position of the full-color toner images on the intermediate transfer belt 601 is aligned with the position of the sheet S at the secondary transfer portion T2. Then, at the secondary transfer portion T2, a bias of a positive polarity is applied to the secondary transfer roller 602, and hence the four-color toner images on the intermediate transfer belt 601 are secondarily transferred onto the conveyed sheet S. Note that, after the toner images are secondarily transferred onto the sheet S, the toner remaining on the intermediate transfer belt 601 is removed by a transfer belt cleaning device 603, and the removed toner is collected into a waste toner collecting container (not shown).

After the toner images are transferred onto the sheet S, the sheet S is conveyed to the fixing portion 604, and is heated and pressurized by the heating roller 604*a* and the pressure roller 604*b* so that the full-color toner images are fixed onto the surface of the sheet S as a permanent image. After the full-color toner images are fixed as a permanent image as described above, in a case of forming an image on one side of the sheet S, the sheet S is then delivered by a sheet delivering portion 600E and stacked onto a sheet stacking portion 600F. In a case of forming images on both sides of the sheet S, on the other hand, the sheet S is conveyed by a duplex conveying portion 600G again to the image forming portion 600B, and after the images are formed on both sides of the sheet S, the sheet S is delivered and stacked onto the sheet stacking portion 600F.

Figure 2A:
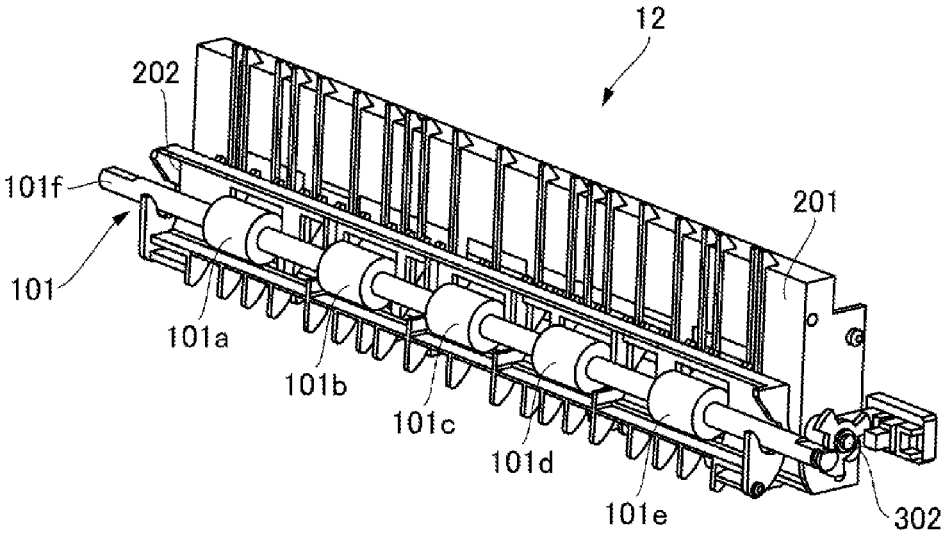
FIGS. 2A and 2B are first explanatory views illustrating the structure of a skew feeding correcting portion provided to the sheet conveying apparatus.
Figure 2B:
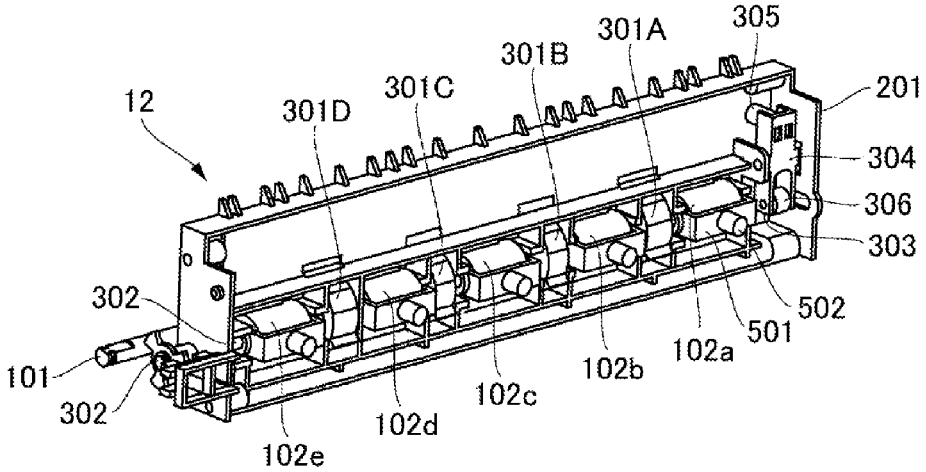

FIGS. 2A and 2B are explanatory views illustrating the structure of the skew feeding correcting portion 12 provided to the sheet conveying apparatus 100. FIG. 2A is a perspective view of the skew feeding correcting portion 12, and FIG. 2B is a perspective view of the skew feeding correcting portion 12 as seen from an opposite side to that in FIG. 2A. The skew feeding correcting portion 12 includes a registration roller pair 101, 102 serving as a rotary member pair, which is formed of a registration roller 101 having a roller shaft 101*f* arranged in parallel to a rotational axis of each photosensitive drum 1, and conveying rotatable members 102 (102*a*, 102*b*, 102*c*, 102*d* and 102*e*). The registration roller 101 includes the roller shaft 101*f*, and a plurality of roller main bodies 101*a*, 101*b*, 101*c*, 101*d* and 101*e* fixed to the roller shaft 101*f* at predetermined intervals. Further, the conveying rotatable members 102*a* to 102*e* are held in pressure contact with the plurality of roller main bodies 101*a* to 101*e* of the registration roller 101, respectively.

Note that, in the embodiment, the conveying rotatable members 102 (102*a* to 102*e*) are rotatably supported by bearing portions (not shown) which are supported to be movable along a direction of the registration roller 101 with respect to a conveyance frame 201 serving as a main body of the sheet conveying apparatus 100. Further, the bearing portions (not shown) are biased toward the registration roller 101 by rotatable member pressing units 501 and rotatable member pressing springs 502 illustrated in FIG. 3, and thus the conveying rotatable members 102*a* to 102*e* are brought into pressure contact with the roller main bodies 101*a* to 101*e*, respectively.

Figure 3:
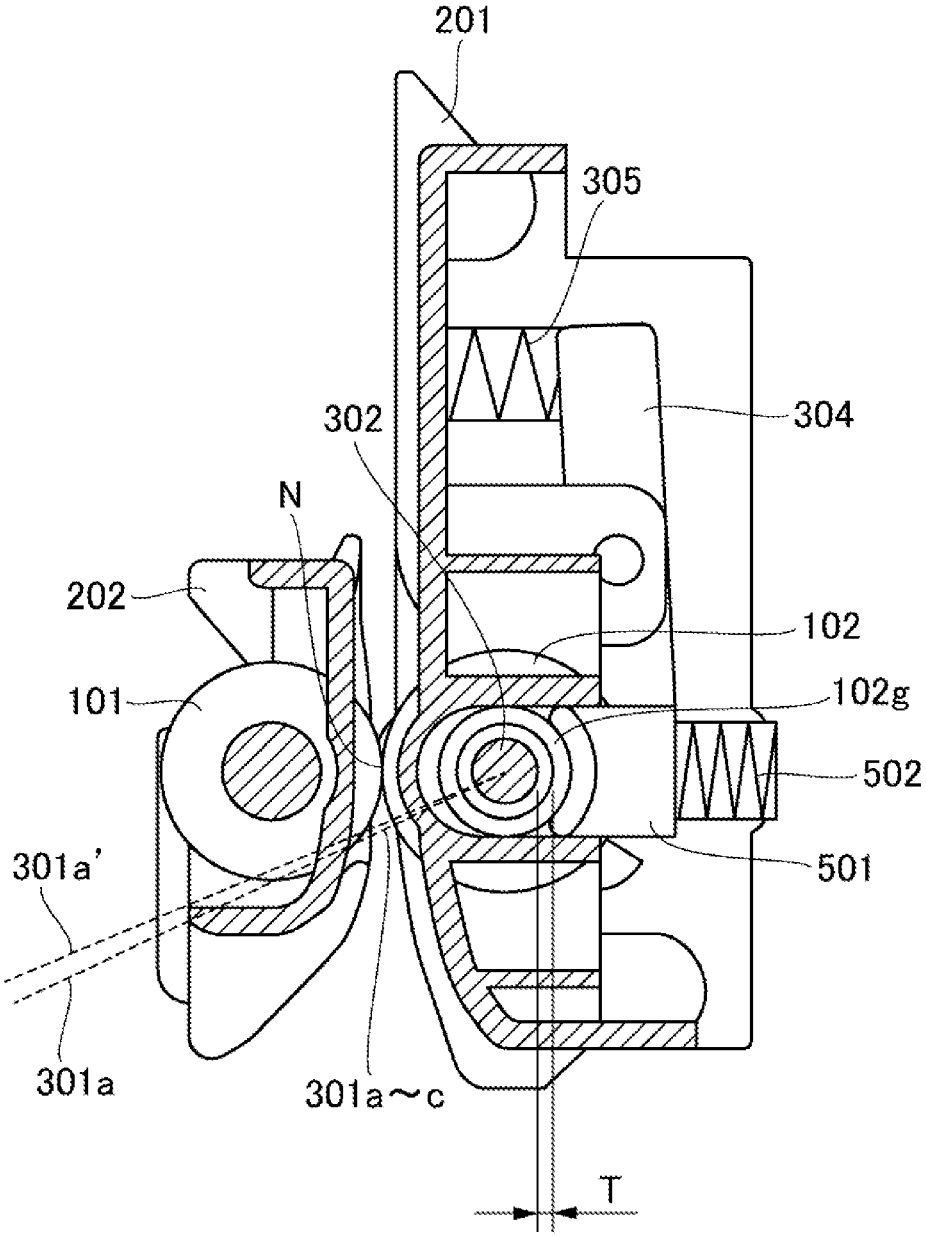
FIG. 3 is a second explanatory view illustrating the structure of the skew feeding correcting portion.
Figure 4:
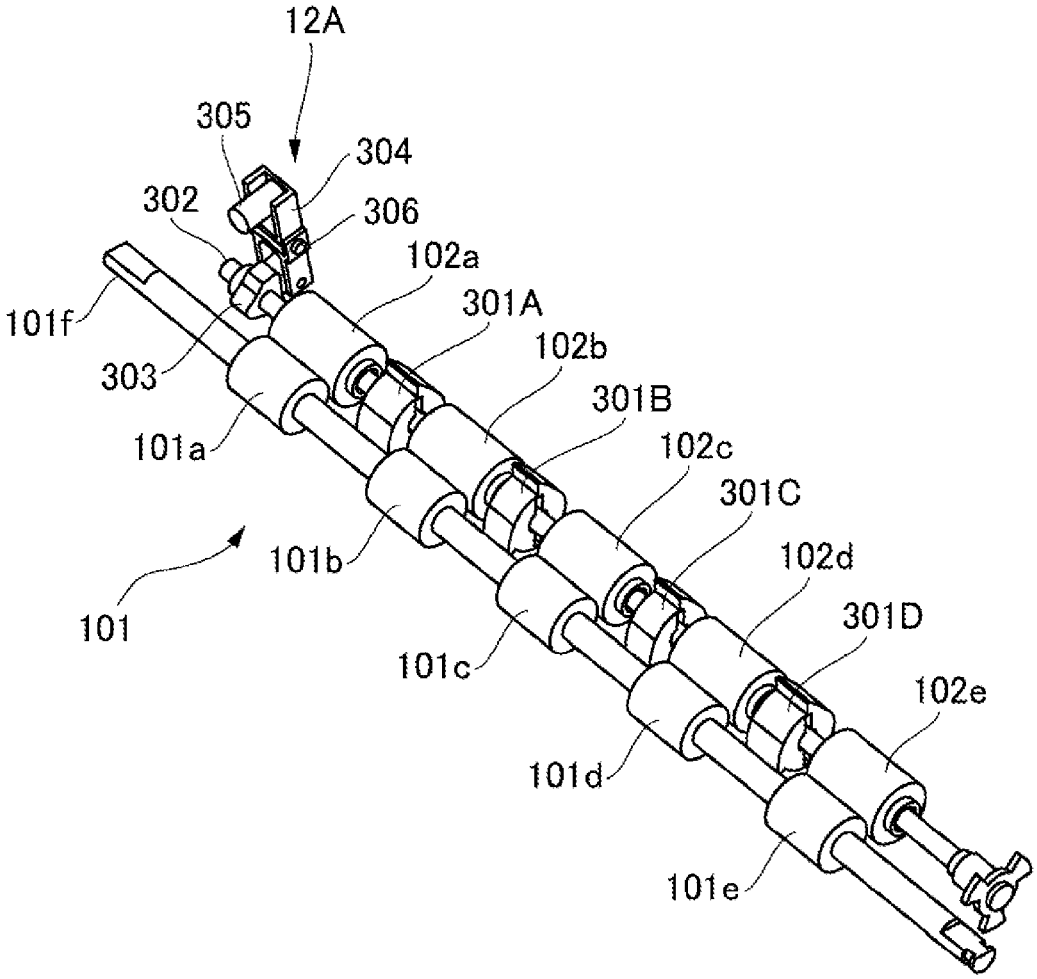
FIG. 4 is an explanatory view illustrating shutter members provided in the skew feeding correcting portion.

Note that, in FIG. 3, a shutter shaft 302 serving as a moving member is supported to be rotatable (movable) with respect to the conveyance frame 201 and to be in parallel to the direction of the rotational axis of each photosensitive drum 1. As illustrated in FIG. 4, the shutter shaft 302 rotatably holds a plurality of shutter members (shutter portion) 301 (301A, 301B, 301C, and 301D). Note that, a shutter cam 303 configured to determine a posture (phase) of each shutter member 301 is provided at one end portion of the shutter shaft 302.

Note that, in FIG. 4, a pressing member 304 is supported to be pivotable with respect to the conveyance frame 201. A cam follower 306 is rotatably supported at a lower end of the pressing member 304. Further, the cam follower 306, which is provided on the pressing member 304, is constantly held in pressure contact with the shutter cam 303 by a shutter spring 305 fixed to the conveyance frame 201. Note that, in the embodiment, the shutter cam 303, the cam follower 306, and the shutter spring 305 serving as a biasing member form a biasing unit 12A configured to bias the shutter shaft 302.

Note that, as illustrated in FIG. 3, the shutter shaft 302 is provided coaxially with a shaft 102*g* of each conveying rotatable member 102 serving as one rotary member of the rotary member pair, and the shaft 102*g* of the conveying rotatable member 102 is supported so as to form a clearance T between the shaft 102*g* and an outer peripheral surface of the shutter shaft 302. Thus, even when the conveying rotatable member 102 is moved, the conveying rotatable member 102 is not brought into contact with the shutter shaft 302, and as a result, a biasing force for the conveying rotatable member 102 from the rotatable member pressing unit 501 and the rotatable member pressing spring 502 is not applied to the shutter shaft 302. Thus, even when the conveying rotatable member 102 is biased, the rotational operation of the shutter members 301A to 301D and the shutter cam 303 which are mounted integrally with the shutter shaft 302 is not hindered.

Figure 5:
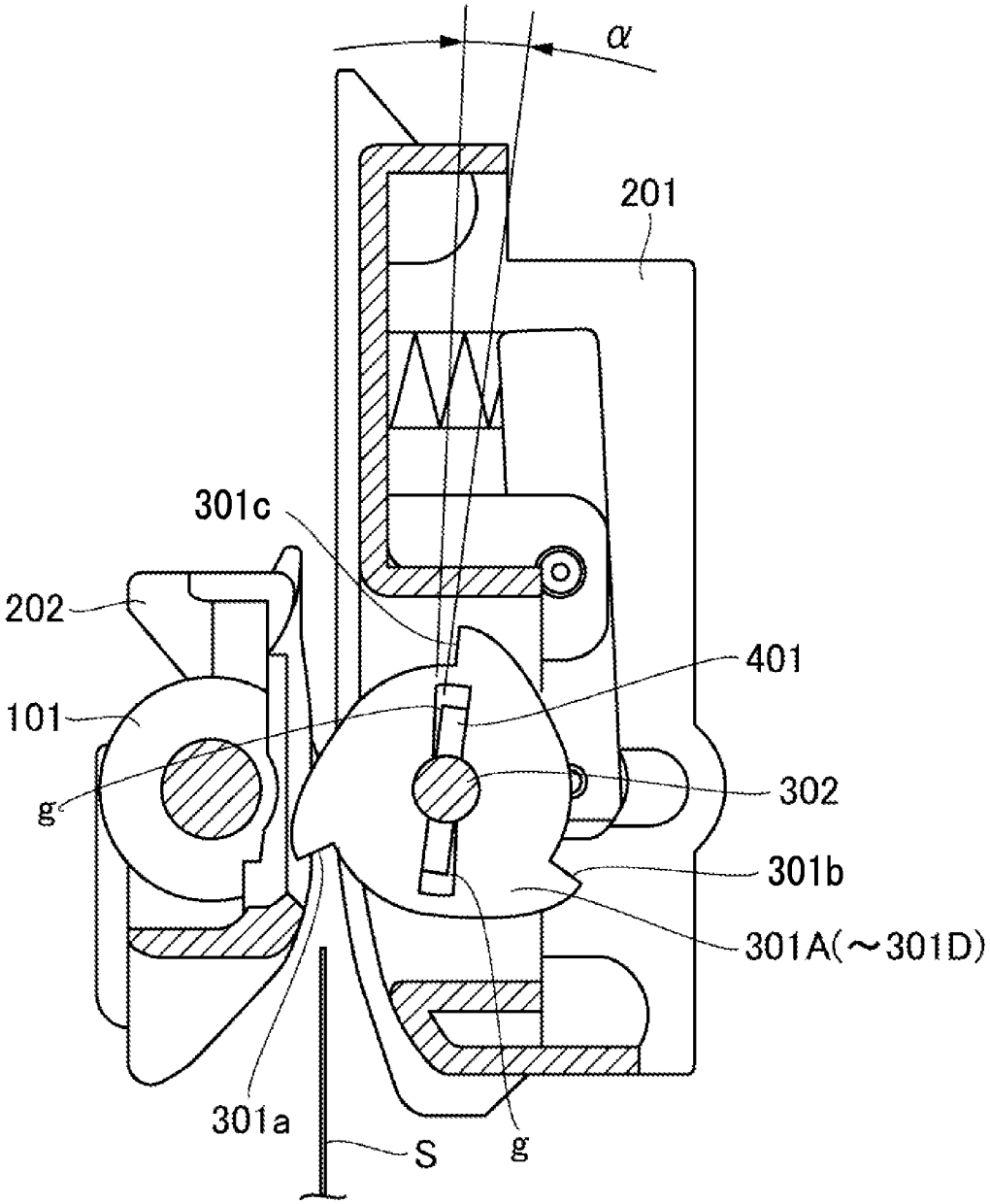
FIG. 5 is a view illustrating a state at the time when the shutter member is positioned in a home position.

As illustrated in FIG. 5, on the shutter shaft 302, there are provided regulating members 401 serving as abutment portions which abut against the plurality of shutter members 301A to 301D provided on the shutter shaft 302 to regulate the rotation of the shutter members 301A to 301D. Further, the plurality of shutter members 301A to 301D are arranged at the same phase on the shutter shaft 302 through an intermediation of the respective regulating members 401. Still further, gaps "g" are formed between the shutter members 301A to 301D and the respective regulating members 401. Thus, the shutter members 301A to 301D are independently rotatable with respect to the shutter shaft 302 by an amount corresponding to a gap angle $\alpha$ between the shutter members 301A to 301D and the respective regulating members 401. Note that, in the embodiment, the gap angle $\alpha$ is set to 5°. Further, on a peripheral surface of each shutter member 301, three (or a plurality of) retaining surfaces 301*a*, 301*b*, and 301*c* which abut against the leading edge of the sheet S to retain the sheet S are provided at regular intervals.

Figure 6:
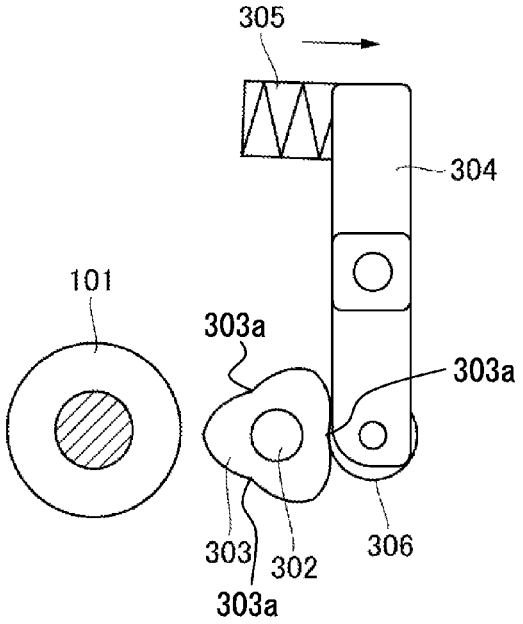
FIG. 6 is a view illustrating a state of a shutter cam at the time when the shutter member is positioned in the home position.

FIG. 5 illustrates a state at the time when the shutter member 301 is positioned in a standby position (hereinafter referred to as "home position"), which is a position of the shutter member 301 before the sheet S abuts against the shutter member 301. At this time, the shutter member 301 takes such a posture that any one of the three retaining surfaces 301*a* to 301*c* is positioned on an upstream side of a nip portion N (see FIG. 3) of the registration roller pair 101, 102 in a sheet conveying direction. FIG. 6 illustrates a state of the shutter cam 303 at this time. The shutter cam 303 is brought into pressure contact with the cam follower 306 of the pressing member 304 which is biased by the shutter spring 305, and hence the shutter member 301 is held in the home position. The shutter cam 303 includes the same number of depressed portions 303*a* as the number of the retaining surfaces 301*a* to 301*c*. When the cam follower 306 engages with one of the depressed portions 303*a*, the shutter shaft 302 and the shutter member 301 are positioned in the home position.

Figure 7:
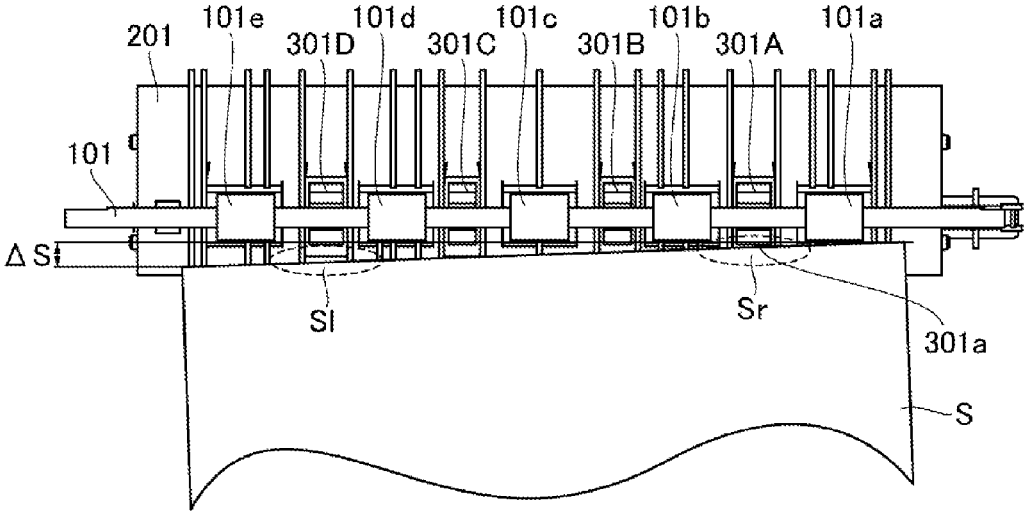
FIG. 7 is a view illustrating a state at the time when a skewed sheet is conveyed to the skew feeding correcting portion.

In general, in the color laser printer 600, as illustrated in FIG. 7, the sheet S fed and conveyed from the sheet feeding cassette 9 may sometimes enter the registration roller pair 101, 102 in a posture inclined by ΔS with respect to the registration roller pair 101, 102. In this case, when the plurality of shutter members 301 fixed to the shutter shaft 302 are not provided, the sheet S is conveyed still in the inclined posture to arrive at the secondary transfer portion T2, and hence the image to be transferred onto the sheet S is formed while being inclined with respect to the sheet S. However, the plurality of shutter members 301 fixed to the shutter shaft 302 are positioned on the upstream side of the nip portion N of the registration roller pair 101, 102 in the sheet conveying direction, and thus the inclination of the sheet S can be corrected.

Next, a skew feeding correcting operation of the skew feeding correcting portion 12 having the above-mentioned structure will be described. First, as illustrated in FIG. 5, an advancing-side leading edge portion of the sheet S conveyed in the inclined posture approaches the retaining surface 301*a* of the shutter member 301A which is positioned on the upstream side of the nip portion N of the registration roller pair 101, 102 in the sheet conveying direction. At this time, as illustrated in FIG. 6, due to a biasing force of the shutter spring 305, the shutter cam 303 rests in the home position which is an abutment position for aligning the leading edge of the sheet S by the retaining surface 301*a* of the shutter member 301A.

Subsequently, as illustrated in FIG. 8A, when the leading edge of the sheet S is brought into contact with the retaining surface 301*a*, the shutter member 301A is pushed by the sheet S and rotated in a direction indicated by the arrow z1. At this time, the gap "g" is formed between the shutter member 301A and the regulating member 401, and hence the shutter member 301A is rotated by an amount corresponding to the gap angle α to abut against the regulating member 401. Thus, the gap "g" is canceled, and the shutter member 301A and the regulating member 401 form the gap angle α therebetween on the opposite side to that before the rotation. As a result, the rotation is temporarily stopped in such a position that the retaining surface 301*a* is positioned in a position indicated by 301*a*'. At this time, sliding resistance generated between the shutter member 301A and the shutter shaft 302 due to the rotation of the shutter member 301A is sufficiently smaller as compared to the biasing force of the shutter spring 305 which determines the posture of the shutter cam 303, and hence, as illustrated in FIG. 8B, there is no change in postures of the regulating member 401 and the shutter shaft 302.

When the shutter member 301A is rotated, the retaining surface 301*a* is moved to the position indicated by 301*a*'. At this time, the position of the retaining surface 301*a* is positioned on the upstream side of the nip portion N of the registration roller pair 101, 102 in the sheet conveying direction. When the rotation of the shutter member 301A is stopped by the regulating member 401, the sheet S receives a reaction force caused by a force for holding the shutter cam 303 biased by the shutter spring 305. The biasing force of the shutter spring 305 is set so that the whole shutter members 301 are not rotatable at the time when one shutter member 301A is pushed by the sheet S as described above.

Subsequently, when the sheet separating portion further conveys the sheet S to achieve a state illustrated in FIG. 8C, the advancing-side leading edge portion of the sheet S conveyed in the inclined posture is still conveyed in a state of being retained by the retaining surface 301*a*' of the shutter member 301A. After that, a delaying-side leading edge portion of the sheet S conveyed in the inclined posture is retained by sequentially abutting against the retaining surfaces 301*a* of the plurality of shutter members 301B, 301C, and 301D arranged in the positions corresponding to the leading edge portion of the sheet S. Through this process, the sheet S forms a loop curved in a direction indicated by the arrow y.

The loop of the sheet S is larger on an Sr side in FIG. 7, on which the sheet S is retained first, than on an Sl side, and then has a predetermined size afterward. When the loop has the predetermined size, due to stiffness (rigidity) of the sheet S, the leading edge of the sheet S is aligned with the retaining surfaces 301*a*' of the shutter members 301A to 301D, with the result that the sheet S becomes in parallel to the direction of the rotational axis of the registration roller pair 101, 102 and the inclination ΔS becomes zero. Note that, also when the correction is thus carried out so that the inclination ΔS of the sheet S becomes zero, as illustrated in FIG. 8D, there is no change in postures of the regulating member 401 and the shutter shaft 302. That is, the shutter shaft 302 is not rotated.

Figure 9A:
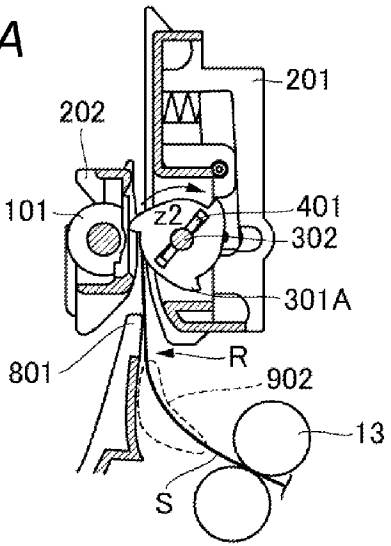
FIGS. 9A, 9B, 9C, and 9D are second explanatory views illustrating the skew feeding correcting operation of the skew feeding correcting portion.

When the sheet S is then aligned with the shutter members 301A to 301D, a force for rotating the shutter members 301A to 301D and the shutter cam 303 about the shutter shaft 302 in a direction indicated by the arrow z2 in FIG. 9A is generated due to the stiffness (rigidity) of the sheet S. Thus, the shutter members 301A to 301D and the shutter shaft 302 are integrally rotated and moved to a passage position for allowing the sheet S to enter the nip portion N of the registration roller pair 101, 102.

Figure 9B:
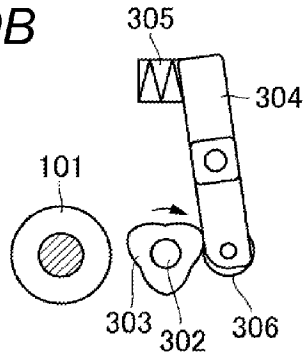

After the sheet S enters the nip portion N of the registration roller pair 101, 102 while rotating the shutter members 301A to 301D, the sheet S is nipped and conveyed by the registration roller pair 101, 102 which starts rotating at a predetermined timing. Note that, when the shutter members 301 are pushed by the sheet S and the shutter shaft 302 is rotated integrally with the shutter members 301, the shutter cam 303 is also rotated as illustrated in FIG. 9B.

Also, when forming the loop of the sheet S, it is desired to form a larger loop inside a sheet conveyance path which is formed by the conveyance frame 201 and a conveyance guide 202, to thereby enhance the skew feeding correcting performance. Therefore, as illustrated in FIG. 9A, it is desired to provide a wide loop forming space 902 in a sheet conveyance path R which is formed by the conveyance frame 201 and the conveyance guide 202, to thereby form a predetermined loop. Note that, the predetermined loop refers to a loop of the sheet S which is formed inside the loop forming space 902 and partially brought into contact with a conveyance guide 801 so that the stiffness (rigidity) of the sheet S becomes higher enough to push up the shutter members 301.

Figure 9C:
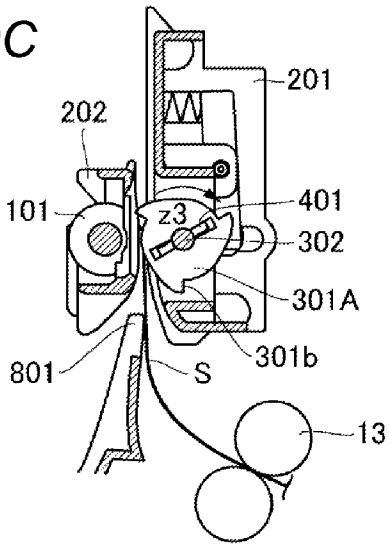
Figure 9D:
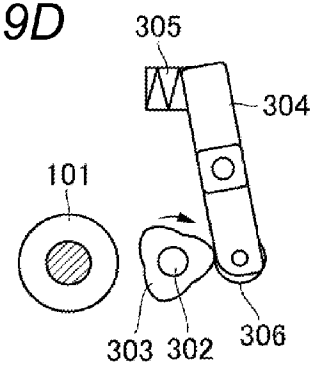
Figure 10A:
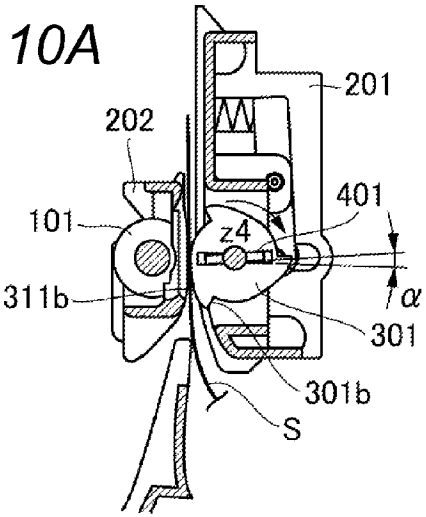
FIGS. 10A, 10B, 10C, and 10D are third explanatory views illustrating the skew feeding correcting operation of the skew feeding correcting portion.

Subsequently, as illustrated in FIG. 9C, along with the travel of the leading edge of the sheet S conveyed due to a conveyance force of the registration roller pair 101, 102, the shutter members 301 (301A to 301D) are rotated in a direction indicated by the arrow z3. When the shutter members 301 are rotated, a top dead center of the shutter cam 303 passes through a contact point between the shutter cam 303 and the cam follower 306 along with the rotation as illustrated in FIG. 9D. When the top dead center of the shutter cam 303 passes through the contact point between the shutter cam 303 and the cam follower 306, a rotational force in a direction indicated by the arrow z4 in FIG. 10A is generated in the shutter members 301 by the shutter cam 303 and the shutter spring 305.

However, at this time, peripheral surfaces 311*b* serving as abutment surfaces of the shutter members 301 are brought into contact with the sheet S that is being conveyed. In this case, the sheet S has higher stiffness through the loop formation, and when the peripheral surfaces 311*b* are brought into contact with the sheet S thus having higher stiffness, the shutter members 301 are stopped without rotating. Note that, even in the state in which the shutter members 301 are not rotated, as illustrated in FIG. 10B, the rotational force is applied to the shutter cam 303 due to the shutter spring 305, and hence the shutter cam 303 and the shutter shaft 302 are rotated by the shutter spring 305. That is, in the embodiment, the peripheral surfaces 311*b* of the shutter members 301 are brought into abutment against the sheet S which is being conveyed so as to stop the shutter members 301. In this manner, only the shutter cam 303 and the shutter shaft 302 are rotated.

Figure 10C:
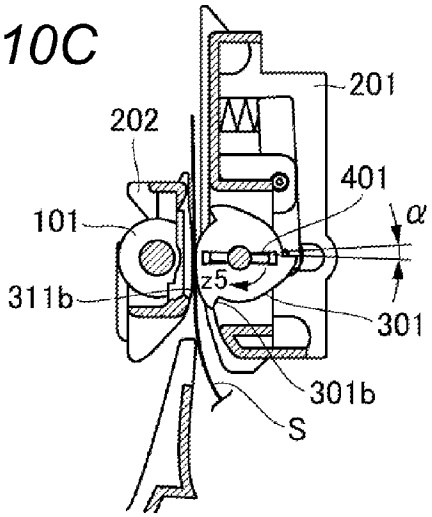
Figure 10B:
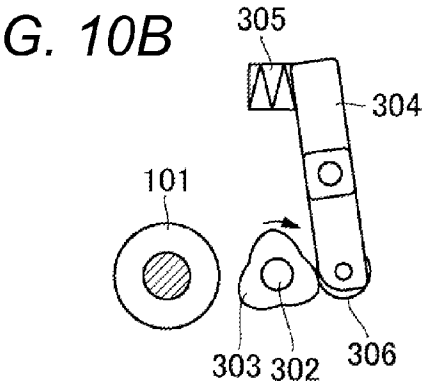
Figure 10D:
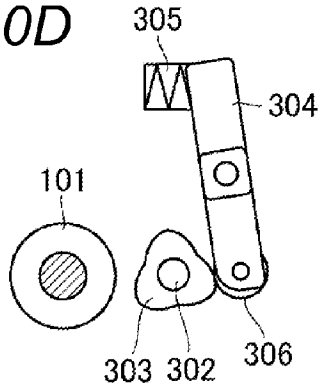

Thus, only the shutter cam 303 and the shutter shaft 302 are rotated by an amount corresponding to the gap angle α in a direction indicated by the arrow z5 in FIG. 10C, and are then stopped by the regulating members 401 in the state in which the gap angle α is formed. In this manner, during the conveyance of the sheet S, the shutter members 301 are held in such a posture that the sheet S is nipped by the peripheral surfaces 311*b* and the conveyance guide 202. Further, after the rotation by the amount corresponding to the gap angle α, the shutter members 301 are stopped, and hence the shutter cam 303 is stopped in a position illustrated in FIG. 10D, in which the top dead center of the shutter cam 303 passes through the contact point between the shutter cam 303 and the cam follower 306.

Subsequently, the sheet S is further conveyed and a trailing edge of the sheet S passes through the sheet separating portion 13. Then, the stiffness of the sheet S becomes lower. When the stiffness of the sheet S becomes lower, the shutter members 301 are gradually rotated in a direction indicated by the arrow z6 in FIG. 11A together with the shutter cam 303 and the shutter shaft 302. At this time, the shutter cam 303 and the shutter shaft 302 are rotated as illustrated in FIG. 11B.

Figure 11C:
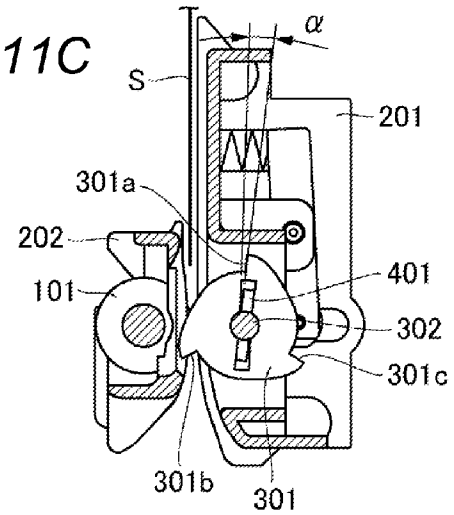
FIGS. 11A, 11B, 11C, and 11D are fourth explanatory views illustrating the skew feeding correcting operation of the skew feeding correcting portion.
Figure 11D:
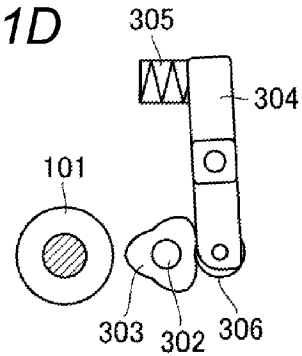
Figure 11A:
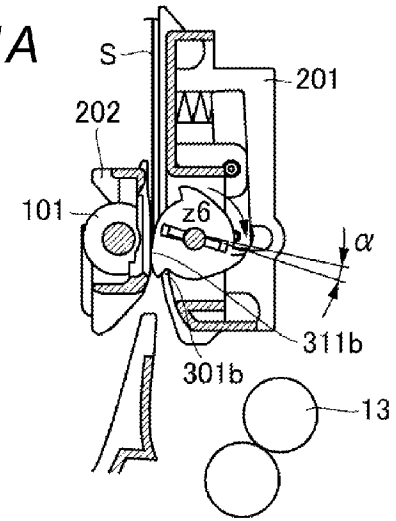
Figure 11B:
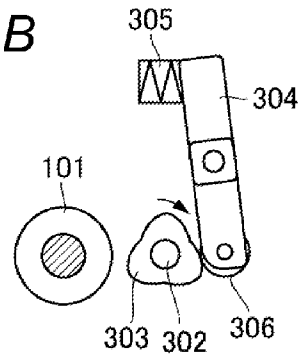

When the trailing edge of the sheet S is completely separated from the shutter members 301, as illustrated in FIG. 11C, the shutter members 301 are brought into a state in which their retaining surfaces 301*b* stand by in the home position for aligning a leading edge of a succeeding sheet S. Further, as illustrated in FIG. 11D, due to the biasing force of the shutter spring 305, the shutter cam 303 is brought back into the state in which the shutter members 301 are held in the home position. After that, every time the sheet S passes through the registration roller pair 101, 102, the retaining surfaces are sequentially switched in an order of the retaining surface 301*a*, the retaining surface 301*b*, the retaining surface 301*c*, and the retaining surface 301*a*, and the respective retaining surfaces retain a leading edge of a newly fed sheet S, to thereby correct the skew feeding of the sheet S.

Figure 12:
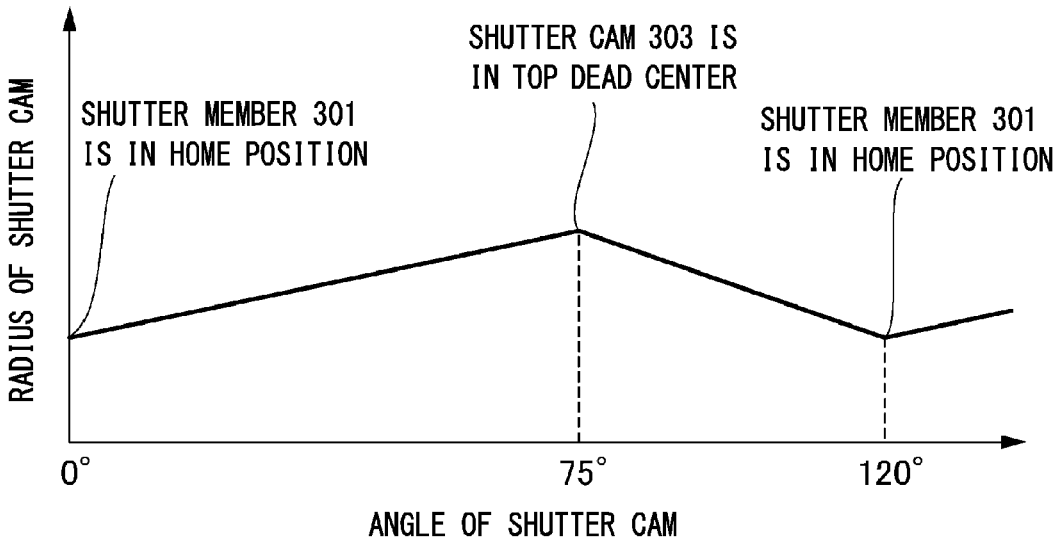
FIG. 12 is a cam diagram illustrating a relationship among a position of the shutter member, a radius of the shutter cam, and an angle of the shutter cam.

Note that, FIG. 12 is a diagram illustrating a relationship among a position of the shutter member 301, a radius of the shutter cam 303, and an angle of the shutter cam 303 as described above. As in the cam diagram of FIG. 12, in the embodiment, when the shutter cam 303 is rotated at 75°, the shutter cam 303 is set so as to move to the position corresponding to the top dead center. When the shutter cam 303 is then further rotated at 45° from the position corresponding to the top dead center, the shutter member 301 is set so as to move to the home position.

As described above, in the embodiment, when the leading edge of the sheet S is brought into contact with the retaining surface 301*a*, only the shutter member 301 is rotated by an amount corresponding to the gap angle α while canceling the gap "g". Through the rotation of only the shutter member 301 described above, it is possible to absorb or reduce a shock received by the skew feeding correcting portion 12 through an intermediation of the shutter member 301. Thus, it is possible to reduce collision sound that is generated when the sheet S is brought into contact with the shutter member 301. That is, as in the embodiment, the regulating member 401 is arranged with the gap "g" formed between the regulating member 401 and the shutter member 301, and the shutter member 301 is brought into abutment against the regulating member 401 during a period in which the shutter member 301 is moved from the abutment position. Thus, it is possible to reduce the collision sound which is generated due to the abutment between the sheet S and the shutter member 301.

Further, in the embodiment, after the shutter member 301 is moved to the passage position, the peripheral surface 311*b* of the shutter member 301 is brought into contact with the sheet S, and then the shutter member 301 is stopped, but the shutter cam 303 and the shutter shaft 302 are rotated by an amount corresponding to the gap angle α. When the shutter member 301 is returned to the home position through the rotational operation of the shutter cam 303 and the shutter shaft 302, the gap angle α is secured constantly. Thus, it is possible to keep the state in which, even when a succeeding sheet S is subsequently conveyed and brought into abutment against the shutter member 301, the collision sound generated due to the abutment between the sheet S and the skew feeding correcting portion 12 is reduced constantly.

Further, in the embodiment, as described above, a larger loop is formed inside the sheet conveyance path R that is formed by the conveyance frame 201 and the conveyance guide 202, to thereby increase the stiffness of the sheet S. Thus, even in a case of conveying a sheet having low rigidity, such as a sheet having a basis weight of 60 g/m$^2$ or less, it is possible to suppress deformation of the leading edge of the sheet when the sheet collides against the shutter member 301, and to enhance the sheet skew feeding correcting performance as well.

Figure 13:
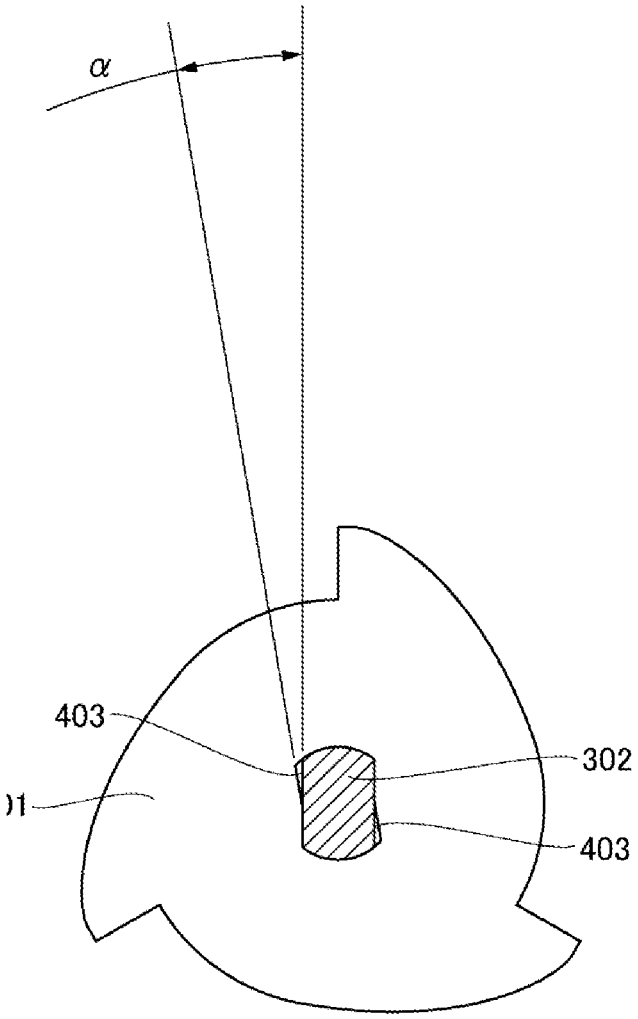
FIG. 13 is a first view illustrating another structure of the skew feeding correcting portion.

The above description is directed to the case where the regulating member 401 is provided on the shutter shaft 302 and the gap "g" is formed between the shutter member 301 and the regulating member 401 so that the shutter member 301 is rotatable by an amount corresponding to the gap angle α, but the present invention is not limited thereto. For example, as illustrated in FIG. 13, a depressed portion 403 configured to form a gap between the shutter member 301 and the shutter shaft 302 may be provided in the shutter member 301. Further, due to the depressed or flattened portion 403, the shutter member 301 may be set independently rotatable with respect to the shutter shaft 302 by an amount corresponding to the gap angle α.

Figure 14:
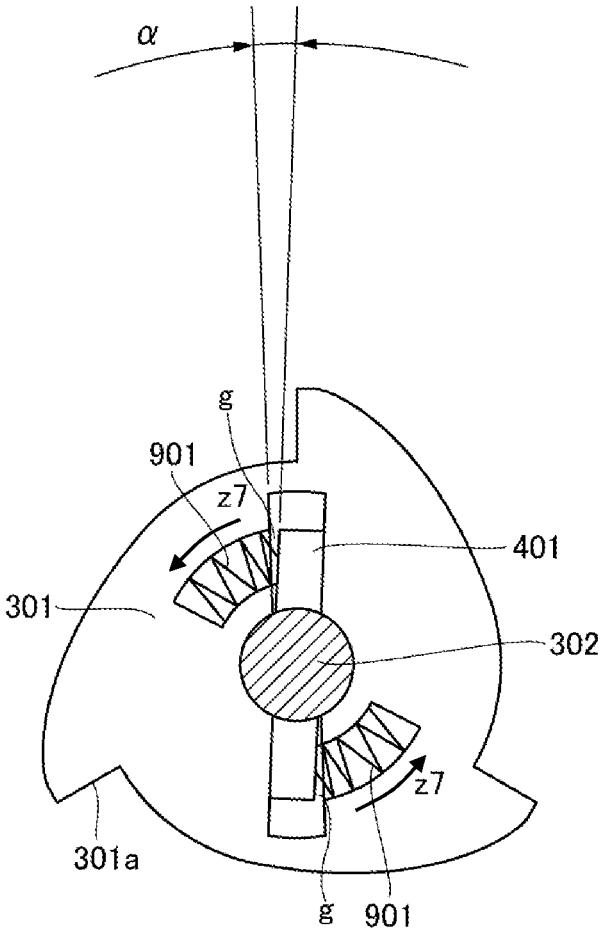
FIG. 14 is a second view illustrating still another structure of the skew feeding correcting portion.

Further, as illustrated in FIG. 14, a spring or an elastic member 901 having spring property, which generates a smaller force than the rotational force generated by the shutter spring 305 and the shutter cam 303, may be provided between the shutter member 301 and the regulating member 401. The elastic member 901 biases the shutter member 301 in a direction indicated by the arrow z7, and thus, after the shutter member 301 is moved to the passage position, the shutter cam 303 and the shutter shaft 302 can reliably be rotated by an amount corresponding to the gap angle α. That is, the elastic member 901 is provided between the shutter member 301 and the regulating member 401, and thus the gap angle α between the shutter member 301 and the regulating member 401 can reliably be kept after the passage of the sheet S without deteriorating the sheet skew feeding correcting function.

Figure 15:
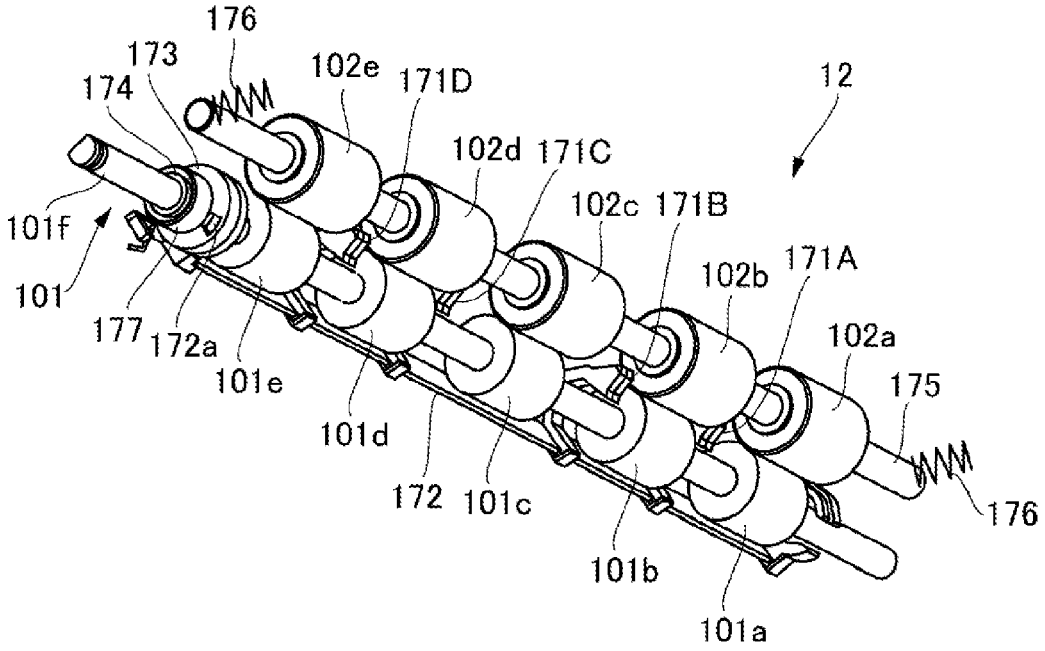
FIG. 15 is an explanatory view illustrating the structure of a skew feeding correcting portion provided in a sheet conveying apparatus according to a second embodiment of the present invention.

Next, a second embodiment of the present invention will be described. FIG. 15 is an explanatory view illustrating the structure of a skew feeding correcting portion provided in a sheet conveying apparatus according to the embodiment. Note that, in FIG. 15, the same reference symbols as those described above in FIG. 4 represent the same or corresponding portions.

In FIG. 15, the conveying rotatable members 102 (102*a* to 102*e*) rotate about a rotatable member shaft 175 in a state in which inner peripheral surfaces of the conveying rotatable members 102 and an outer peripheral surface of the rotatable member shaft 175 are held in contact with each other. Further, the conveying rotatable members 102 are pressed against the plurality of roller main bodies 101*a* to 101*e* of the registration roller 101 by rotatable member shaft pressing springs 176 provided at both ends of the rotatable member shaft 175.

Further, shutter members 171 (171A, 171B, 171C, and 171D) are fixed at the same phase to a shutter holding member 172. A shutter portion in this embodiment is constructed of the shutter members 171A, 171B, 171C, and 171D and the shutter holding member 172. The shutter holding member 172 is pivotably supported by the roller shaft 101*f* of the registration roller 101 through an intermediation of a pivotal movement regulating member 173 and a roller bearing 174 serving as the moving members.

Figure 16A:
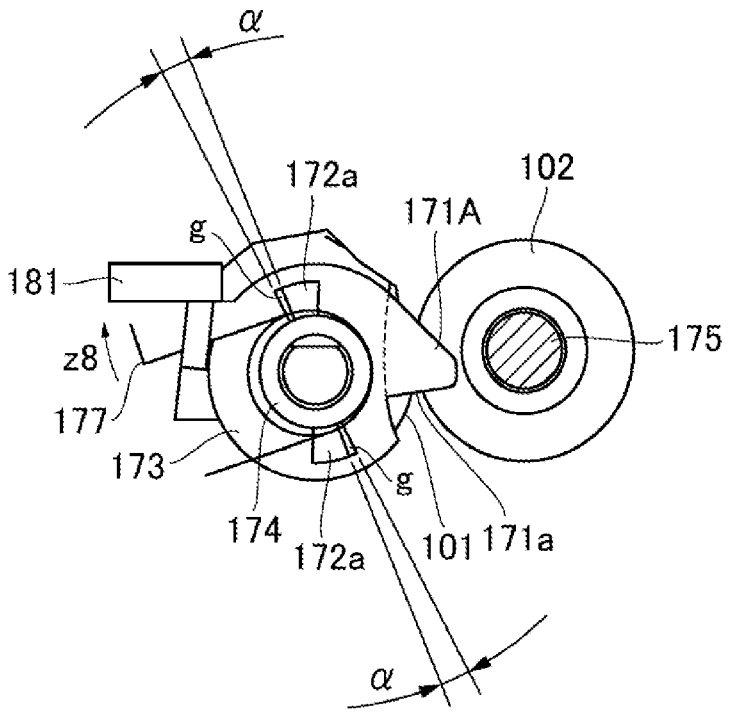
FIGS. 16A and 16B are first explanatory views illustrating a skew feeding correcting operation of the skew feeding correcting portion.
Figure 16B:
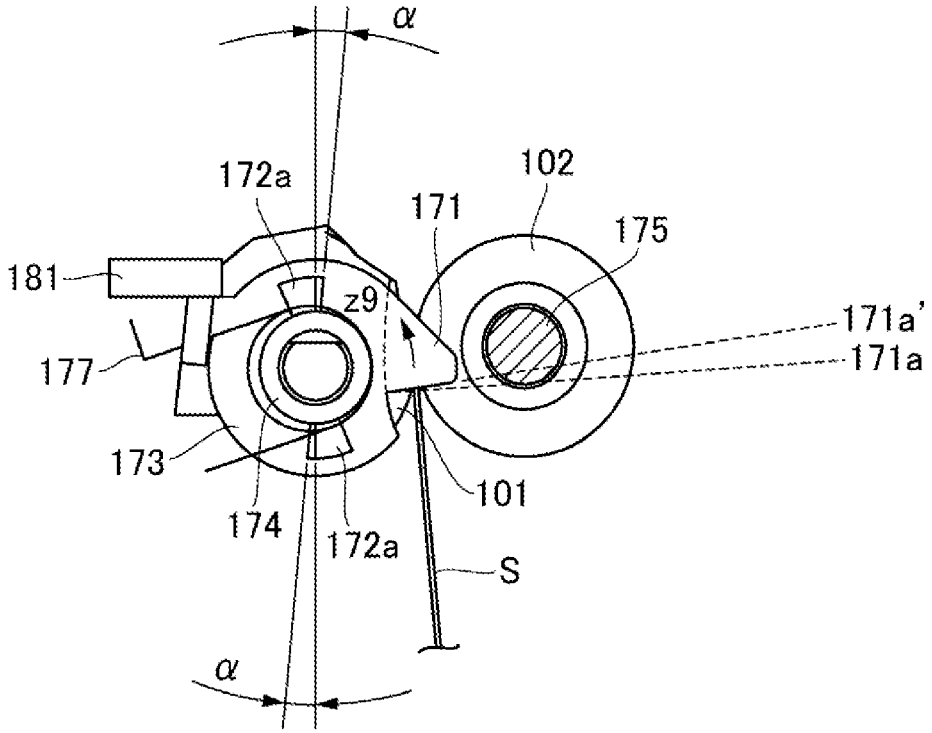

The shutter holding member 172 includes a regulating portion 172*a*. As illustrated in FIGS. 16A and 16B, the regulating portion 172*a* and the pivotal movement regulating member 173 form the gap "g" therebetween. Further, the shutter holding member 172, that is, the shutter member 171 is independently rotatable with respect to the pivotal movement regulating member 173 by an amount corresponding to the gap angle α which is an angle of the gap "g". Note that, in the embodiment, the gap angle α is set to 5°.

Further, during a period other than the period in which the sheet S is conveyed, the position of the shutter holding member 172 is kept by the pivotal movement regulating member 173 in such a posture that a retaining surface 171*a* of the shutter member 171 is positioned on the upstream side of the nip portion N of the registration roller pair 101, 102 in the sheet conveying direction. Note that, the pivotal movement regulating member 173 is biased in a direction indicated by the arrow z8 by a pivotal spring 177 serving as the biasing unit, and the posture in the home position is regulated by a stopper 181.

Next, a skew feeding correcting operation of the skew feeding correcting portion 12 having the above-mentioned structure will be described. First, as illustrated in FIG. 16B, the leading edge of the conveyed sheet S is brought into contact with the retaining surface 171*a* of, for example, the shutter member 171A illustrated in FIG. 16A among the plurality of shutter members 171A to 171D positioned in the home position.

When the leading edge of the sheet S is brought into contact as described above, the shutter member 171A is pushed by the sheet S and pivoted in a direction indicated by the arrow z9 together with the shutter holding member 172. When the shutter holding member 172 is pivoted by an amount corresponding to the gap angle α, the regulating portion 172*a* abuts against the pivotal movement regulating member 173, and the regulating portion 172*a* and the pivotal movement regulating member 173 form the gap angle α therebetween on the opposite side to that before the pivotal movement. As a result, the pivotal movement is stopped in such a position that the retaining surface 171*a* is positioned in a position indicated by 171*a*'.

At this time, sliding resistance between the roller bearing 174 and the roller shaft 101*f* caused by the pivotal movement of the shutter holding member 172 is sufficiently smaller as compared to the biasing force of the pivotal spring 177, and hence there is no change in posture of the pivotal movement regulating member 173. Further, the retaining surface 171*a*' is positioned on the upstream side of the nip portion N of the registration roller pair 101, 102 in the sheet conveying direction.

When the pivotal movement of the shutter holding member 172 is stopped by the pivotal movement regulating member 173, the sheet S receives a reaction force of the pivotal spring 177. The biasing force of the pivotal spring 177 is set so that the whole shutter members 171 are not rotatable at the time when one shutter member 171A is pushed by the sheet S as described above.

However, after that, the sheet S is further conveyed, and a predetermined loop is formed in the sheet S as described above. Then, the inclination of the leading edge of the sheet S is corrected, and the leading edge of the sheet S pushes up the shutter members 171. Thus, the sheet S enters the nip portion N of the registration roller pair 101, 102, and is conveyed by the registration roller pair 101, 102.

Figure 17A:
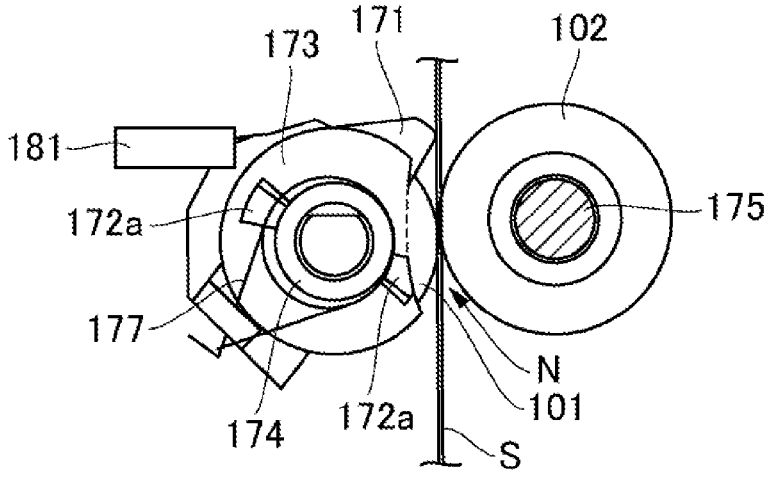
FIGS. 17A and 17B are second explanatory views illustrating the skew feeding correcting operation of the skew feeding correcting portion.

When the shutter members 171 are pushed up, the shutter holding member 172 is pushed up integrally with the shutter members 171, and further, the pivotal movement regulating member 173 is pivoted together with the shutter holding member 172 through an intermediation of the regulating portion 172*a* of the shutter holding member 172. Thus, during the conveyance of the sheet S, as illustrated in FIG. 17A, the sheet S is conveyed in a state in which the ends of the shutter members 171 abut against the sheet S due to the biasing force of the pivotal spring 177.

Figure 17B:
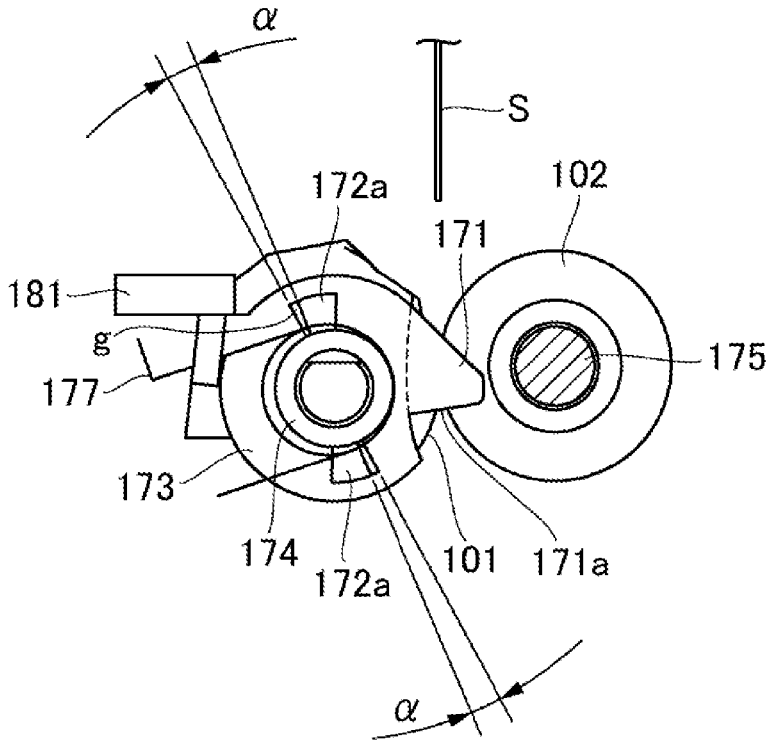

When the sheet S then passes through the skew feeding correcting portion 12 as illustrated in FIG. 17B, due to the biasing force of the pivotal spring 177, the pivotal movement regulating member 173 is moved in a direction opposite to the movement direction to return to the home position illustrated in FIG. 16A. Note that, in the embodiment, gravity center positions of the shutter holding member 172 and the shutter members 171 are set on the side of the nip portion N instead of the center of the roller shaft 101*f* of the registration roller 101. Therefore, when the pivotal movement regulating member 173 returns to the home position, due to self-weights of the shutter holding member 172 and the shutter members 171 and the rotational force generated by the pivotal spring 177, the shutter holding member 172 and the shutter members 171 return to the home position while forming the gap angle α. That is, when the sheet S passes through the shutter members 171, the pivotal movement regulating member 173 is moved due to the biasing force of the pivotal spring 177 while moving the shutter members 171 in a direction opposite to the movement direction.

As described above, in the embodiment, after the leading edge of the sheet S is brought into contact with the retaining surface 171*a*, only the shutter holding member 172, that is, the shutter member 171 is pivoted by an amount corresponding to the gap angle α before the skew feeding correcting operation is started. Through the pivotal movement of the shutter holding member 172 described above, it is possible to absorb a shock received by the skew feeding correcting portion 12 through an intermediation of the shutter member 171 from the leading edge of the sheet S conveyed by the sheet separating portion 13. Thus, it is possible to reduce collision sound that is generated when the sheet S is brought into contact with the shutter member 171.

Note that, the above description is directed to the case where the shutter holding member 172 (shutter member 171) is pivoted about a fulcrum corresponding to the roller shaft 101*f* of the registration roller 101, but the present invention is not limited thereto. The shutter holding member 172 (shutter member 171) may be pivoted about a fulcrum corresponding to the rotatable member shaft 175 of the conveying rotatable member 102. That is, it is only necessary that the shutter holding member 172 (shutter member 171) be provided to be pivotable about any one of the shafts of the registration roller pair 101, 102.

Figure 18A:
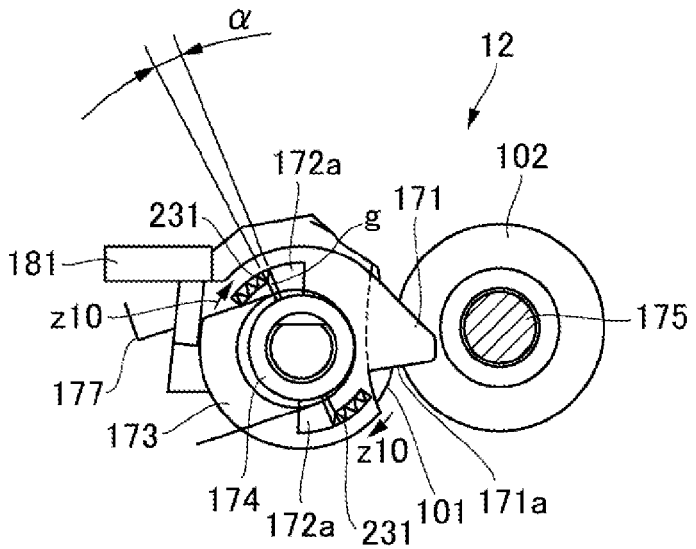
FIGS. 18A and 18B are views illustrating another structure of the skew feeding correcting portion.

Further, as illustrated in FIG. 18A, a spring or an elastic member 231 having spring property, which generates a smaller spring force than the force of the pivotal spring 177 and biases the regulating portion 172*a* in a direction indicated by the arrow z10, may be provided between the regulating portion 172*a* of the shutter holding member 172 and the pivotal movement regulating member 173. Thus, the gap angle α between the shutter holding member 172 and the pivotal movement regulating member 173 can reliably be kept after the passage of the sheet S without deteriorating the sheet skew feeding correcting function.

Figure 18B:
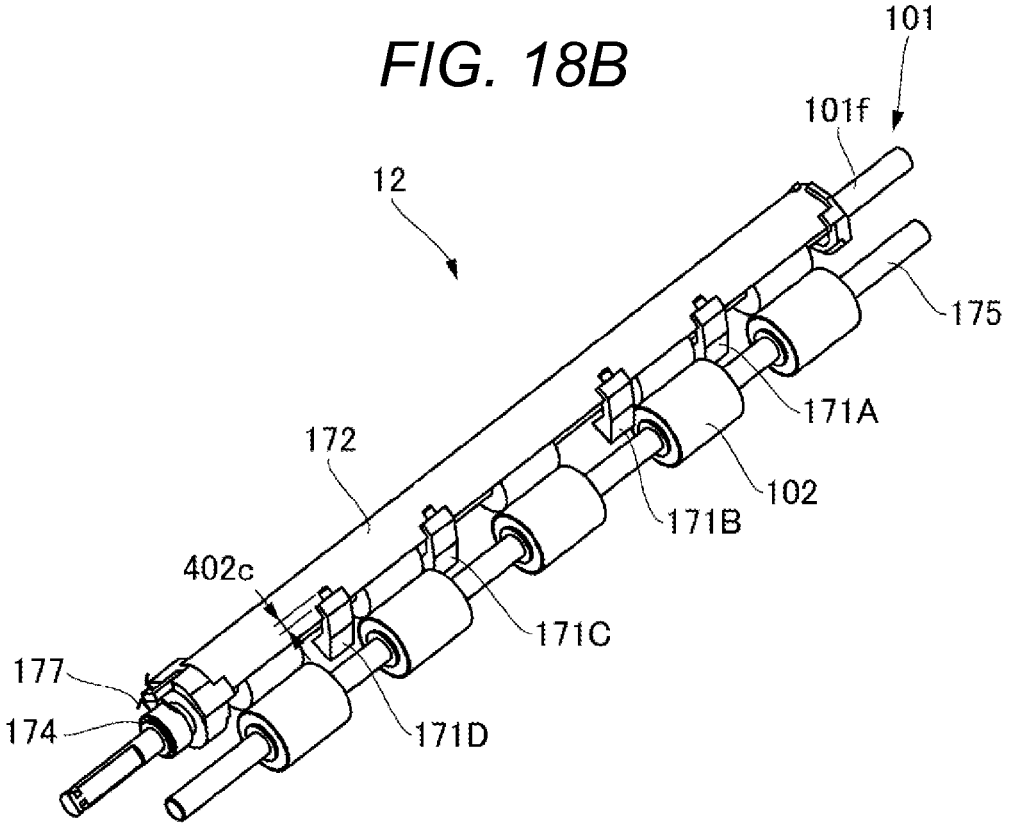

Still further, as illustrated in FIG. 18B, the shutter member 171 may be provided to be movable by an amount corresponding to a gap distance 402*c* with respect to the shutter holding member 172, and the shutter holding member 172 may be biased directly by the pivotal spring 177. Thus, when the leading edge of the sheet S abuts against the retaining surface 171*a*, only the shutter member 171 is moved by the amount corresponding to the gap distance 402*c*, and hence the effect of reducing the collision sound can be attained. Note that, in this structure, the shutter holding member 172 serves as the moving member.

In the embodiment, the moving member movable integrally with the shutter member is arranged with the gap formed between the moving member and the shutter member, and the gap is canceled during a period in which the shutter member is moved from the abutment position to the passage position. Thus, it is possible to reduce the collision sound which is generated due to the abutment between the sheet and the shutter member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-283306, filed Dec. 26, 2012, which is hereby incorporated by reference herein in its entirety.

What is claimed is:

1. A sheet conveying apparatus comprising:

a rotatable rotary member;

a movable abutment member having an abutment portion against which a leading edge of a conveyed sheet abuts at an abutment position, the abutment member being moved with respect to the rotary member as a result of the abutment portion positioned at the abutment position being pushed by the conveyed sheet, the abutment member being rotated integrally with the rotary member after the abutment member is moved with respect to the rotary member; and a positioning member configured to position the abutment portion at the abutment position by rotating the rotary member after a leading edge of a first sheet passes the abutment position and before a leading edge of a sheet, which is conveyed after the first sheet, reaches the abutment position.

2. A sheet conveying apparatus according to claim 1, wherein the rotary member is rotated integrally with the abutment member as a result of the abutment member pushing the rotary member.

3. A sheet conveying apparatus according to claim 2, wherein the positioning member rotates the rotary member with respect to the abutment member after the rotary member is rotated integrally with the abutment member by the conveyed sheet, and wherein after the rotary member is rotated with the abutment member, the rotary member is rotated integrally with the abutment member so that the abutment member is positioned at the abutment position.

4. A sheet conveying apparatus according to claim 3, wherein the abutment member has a first contacting portion, and the rotary member has a first contacted portion which is contacted by the first contacting portion, wherein the first contacting portion is out of contact with the first contacted portion in a state in which the abutment portion is positioned at the abutment position, wherein the first contacted portion is pushed by the first contacting portion as a result of the abutment member being rotated with respect to the rotary member by the abutment portion being pushed by a sheet, and the rotary member is rotated integrally with the abutment member as a result of the first contacted portion being pushed by the first contacting portion, and wherein the first contacting portion and the first contacted portion enter a state in which the first contacting portion is out of contact with the first contacted portion as a result of the positioning member rotating the rotary member with respect to the abutment member.

5. A sheet conveying apparatus according to claim 4, wherein the abutment member has a second contacting portion, and the rotary member has a second contacted portion which is contacted by the second contacting portion, and wherein when the positioning member rotates the rotary member, the rotary member is rotated integrally with the abutment member as a result of the second contacting portion being pushed by the second contacted portion.

6. A sheet conveying apparatus according to claim 1, wherein the abutment member is rotated with respect to the rotary member.

7. A sheet conveying apparatus according to claim 6, wherein there is a first gap between the abutment member and the rotary member so that the abutment member can be rotated with respect to the rotary member in a state in which the abutment portion is positioned at the abutment position.

8. A sheet conveying apparatus according to claim 7, wherein there is a second gap between the abutment member and the rotary member so that the rotary member can be rotated with respect to the abutment member after the rotary member is rotated integrally with the abutment member.

9. A sheet conveying apparatus according to claim 8, wherein the first gap and the second gap are provided inside the abutment member.

10. A sheet conveying apparatus according to claim 6, wherein the abutment member can be rotated by approximate 5 degrees with respect to the rotary member.

11. A sheet conveying apparatus according to claim 1, wherein the abutment member has a plurality of abutment portions in a circumferential direction of the abutment member.

12. A sheet conveying apparatus according to claim 1, further comprising a plurality of abutment members provided in a width direction orthogonal to a sheet conveying direction.

13. A sheet conveying apparatus according to claim 12, wherein the rotary member is provided on a shaft configured to support the plurality of abutment members.

14. A sheet conveying apparatus according to claim 1, wherein a direction in which the rotary member is rotated by the positioning member is the same as a direction in which the rotary member is rotated integrally with the abutment member after the abutment member is moved with respect to the rotary member.

15. A sheet conveying apparatus according to claim 14, further comprising a pair of rollers configured to nip and convey a sheet by a nip portion of the pair of rollers downstream of the abutment position in a sheet conveying direction.

16. A sheet conveying apparatus according to claim 15, wherein the positioning member rotates the rotary member after the leading edge of the conveyed sheet is nipped by the pair of rollers.

17. A sheet conveying apparatus according to claim 16, wherein the abutment member has other contacting portion configured to be brought into contact with a surface of the sheet nipped by the pair of rollers, and wherein the other contacting portion is brought into contact with the surface of the sheet by the rotary member being rotated by the positioning member.

18. A sheet conveying apparatus according to claim 1, wherein a skew feeding of the sheet is corrected by the leading edge of the conveyed sheet abutting the abutment portion.

19. A sheet conveying apparatus according to claim 1, wherein the positioning member has an elastic member configured to generate an elastic force.

20. A sheet conveying apparatus according to claim 19, wherein the positioning member has a rotary cam and a cam follower.

21. A sheet conveying apparatus comprising:

a rotary member rotatable in a predetermined direction;

a movable abutment member having a first abutment portion against which a leading edge of a first sheet abuts at an abutment position and a second abutment portion against which a leading edge of a second sheet subsequent to the first sheet abuts at the abutment position, the abutment member being moved with respect to the rotary member as a result of the abutment member being pushed by a conveyed sheet, the abutment member being rotated integrally with the rotary member in the predetermined direction after the abutment member is moved with respect to the rotary member; and a positioning member configured to position the second abutment portion at the abutment position by rotating the rotary member in the predetermined direction after the leading edge of the first sheet passes the abutment position and before the leading edge of the second sheet reaches the abutment position.

22. A sheet conveying apparatus according to claim 21, wherein the rotary member is rotated integrally with the abutment member as a result of the abutment member pushing the rotary member.

23. A sheet conveying apparatus according to claim 22, wherein the positioning member rotates the rotary member with respect to the abutment member after the rotary member is rotated integrally with the abutment member by the conveyed sheet, and wherein after the rotary member is rotated with the abutment member, the rotary member is rotated integrally with the abutment member so that the abutment member is positioned at the abutment position.

24. A sheet conveying apparatus according to claim 23, wherein the abutment member has a first contacting portion, and the rotary member has a first contacted portion which is contacted by the first contacting portion, wherein the first contacting portion is out of contact with the first contacted portion in a state in which the abutment portion is positioned at the abutment position, wherein the first contacted portion is pushed by the first contacting portion by the abutment member being rotated with respect to the rotary member as a result of the abutment portion being pushed by a sheet, and the rotary member is rotated integrally with the abutment member as a result of the first contacted portion being pushed by the first contacting portion, and wherein the first contacting portion and the first contacted portion enter a state in which the first contacting portion is out of contact with the first contacted portion by the positioning member rotating the rotary member with respect to the abutment member.

25. A sheet conveying apparatus according to claim 24, wherein the abutment member has a second contacting portion, and the rotary member has a second contacted portion which is contacted by the second contacting portion, and wherein when the positioning member rotates the rotary member, the rotary member is rotated integrally with the abutment member as a result of the second contacting portion being pushed by the second contacted portion.

26. A sheet conveying apparatus according to claim 21, wherein the abutment member is rotated with respect to the rotary member.

27. A sheet conveying apparatus according to claim 26, wherein there is a first gap between the abutment member and the rotary member so that the abutment member can be rotated with respect to the rotary member in a state in which the abutment portion is positioned at the abutment position.

28. A sheet conveying apparatus according to claim 27, wherein there is a second gap between the abutment member and the rotary member so that the rotary member can be rotated with respect to the abutment member after the rotary member is rotated integrally with the abutment member.

29. A sheet conveying apparatus according to claim 28, wherein the first gap and the second gap are provided inside the abutment member.

30. A sheet conveying apparatus according to claim 26, wherein the abutment member can be rotated by approximate 5 degrees with respect to the rotary member.

31. A sheet conveying apparatus according to claim 21, further comprising a plurality of abutment members provided in a width direction orthogonal to a sheet conveying direction.

32. A sheet conveying apparatus according to claim 31, wherein the rotary member is provided on a shaft configured to support the plurality of abutment members.

33. A sheet conveying apparatus according to claim 21, wherein a direction in which the rotary member is rotated by the positioning member is the same as a direction in which the rotary member is rotated integrally with the abutment member after the abutment member is moved with respect to the rotary member.

34. A sheet conveying apparatus according to claim 33, further comprising a pair of rollers configured to nip and convey a sheet by a nip portion of the pair of rollers downstream of the abutment position in a sheet conveying direction.

35. A sheet conveying apparatus according to claim 34, wherein the positioning member rotates the rotary member after the leading edge of the conveyed sheet is nipped by the pair of rollers.

36. A sheet conveying apparatus according to claim 35, wherein the abutment member has a contacting portion configured to be brought into contact with a surface of the sheet nipped by the pair of rollers, and wherein the contacting portion is brought into contact with the surface of the sheet as a result of the rotary member being rotated by the positioning member.

37. A sheet conveying apparatus according to claim 21, wherein a skew feeding of the sheet is corrected by the leading edge of the conveyed sheet abutting the abutment portion.

38. A sheet conveying apparatus according to claim 21, wherein the positioning member has an elastic member configured to generate an elastic force.

39. A sheet conveying apparatus according to claim 38, wherein the positioning member has a rotary cam and a cam follower.

40. A sheet conveying apparatus comprising:

a rotatable first rotary member;

a rotatable second rotary member disposed in a different position from the first rotary member in a direction orthogonal to a sheet conveying direction;

a rotary shaft on which the first rotary member and the second rotary member are provided, the first rotary member and the second rotary member are rotated integrally with each other by the rotary shaft being rotated;

a movable first abutment member having a first abutment portion against which a leading edge of a conveyed sheet abuts at a first abutment position, the first abutment member being moved with respect to the first rotary member by the first abutment portion positioned at the first abutment position being pushed by the conveyed sheet; and a movable second abutment member having a second abutment portion disposed in a different position from the first abutment member in the orthogonal direction and against which a leading edge of a conveyed sheet abuts at the second abutment position, the second abutment member being moved with respect to the second rotary member by the second abutment portion positioned at the second abutment position being pushed by the conveyed sheet, wherein the rotary shaft is rotated by the first abutment member abutting the first rotary member after the first abutment member is moved with respect to the first rotary member and the second abutment member abutting the second rotary member after the second abutment member is moved with respect to the second rotary member.

41. A sheet conveying apparatus according to claim 40, wherein the first rotary member is rotated integrally with the first abutment member as a result of the first abutment member pushing the first rotary member.

42. A sheet conveying apparatus according to claim 41, further comprising a positioning member configured to rotate the first rotary member with respect to the first abutment member after the first rotary member is rotated integrally with the first abutment member by the conveyed sheet, wherein after the first rotary member is rotated with the first abutment member, the first rotary member is rotated integrally with the first abutment member so that the first abutment member is positioned at the first abutment position.

43. A sheet conveying apparatus according to claim 42, wherein the first abutment member has a first contacting portion, and the first rotary member has a first contacted portion which is contacted by the first contacting portion, wherein the first contacting portion is out of contact with the first contacted portion in a state in which the first abutment portion is positioned at the first abutment position, wherein the first contacted portion is pushed by the first contacting portion by the first abutment member being rotated with respect to the rotary member by the first abutment portion being pushed by a sheet, and the first rotary member is rotated integrally with the first abutment member by the first contacted portion being pushed by the first contacting portion, and wherein the first contacting portion and the first contacted portion enter a state in which the first contacting portion is out of contact with the first contacted portion as a result of the first positioning member rotating the first rotary member with respect to the first abutment member.

44. A sheet conveying apparatus according to claim 43, wherein the second abutment member has a second contacting portion, and the second rotary member has a second contacted portion which is contacted by the second contacting portion, and wherein when the second positioning member rotates the second rotary member, the second rotary member is rotated integrally with the second abutment member by the second contacting portion being pushed by the second contacted portion.

45. A sheet conveying apparatus according to claim 40, wherein the first abutment member is rotated with respect to the first rotary member.

46. A sheet conveying apparatus according to claim 45, wherein there is a first gap between the first abutment member and the first rotary member so that the first abutment member can be rotated with respect to the rotary member in a state in which the first abutment portion is positioned at the first abutment position.

47. A sheet conveying apparatus according to claim 46, wherein there is a second gap between the second abutment member and the second rotary member so that the second rotary member can be rotated with respect to the second abutment member after the second rotary member is rotated integrally with the second abutment member.

48. A sheet conveying apparatus according to claim 47, wherein the first gap and the second gap are provided inside the first abutment member.

49. A sheet conveying apparatus according to claim 45, wherein the first abutment member can be rotated by approximate 5 degrees with respect to the first rotary member.

50. A sheet conveying apparatus according to claim 40, wherein the first abutment member has a plurality of abutment portions in a circumferential direction of the first abutment member.

51. A sheet conveying apparatus according to claim 40, wherein a direction in which the first rotary member is rotated by the first positioning member is the same as a direction in which the first rotary member is rotated integrally with the first abutment member after the first abutment member is moved with respect to the first rotary member.

52. A sheet conveying apparatus according to claim 51, further comprising a pair of rollers configured to nip and convey a sheet by a nip portion of the pair of rollers downstream of the first abutment position in a sheet conveying direction.

53. A sheet conveying apparatus according to claim 52, wherein the positioning member rotates the rotary member after the leading edge of the conveyed sheet is nipped by the pair of rollers.

54. A sheet conveying apparatus according to claim 53, wherein the second abutment member has a second contacting portion configured to be brought into contact with a surface of the sheet nipped by the pair of rollers, and wherein the second contacting portion is brought into contact with the surface of the sheet by the first rotary member being rotated by the first positioning member.

55. A sheet conveying apparatus according to claim 40, wherein a skew feeding of the sheet is corrected by the leading edge of the conveyed sheet abutting the first abutment portion.

56. A sheet conveying apparatus according to claim 40, wherein the first positioning member has an elastic member configured to generate an elastic force.

57. A sheet conveying apparatus according to claim 56, wherein the first positioning member has a rotary cam and a cam follower.

* * * * *